United States Patent [19]

Hayden

[11] 4,064,470

[45] Dec. 20, 1977

[54] OBTURATOR STRUCTURE FOR SILENT AUTOMOTIVE RELAY

[75] Inventor: Rodney Hayden, Stoney Creek, Canada

[73] Assignee: TRW Inc., Cleveland, Ohio

[21] Appl. No.: 588,865

[22] Filed: June 20, 1975

[51] Int. Cl.[2] ..... H01H 1/00

[52] U.S. Cl. ..... 335/196; 335/124; 335/187; 335/203

[58] Field of Search ..... 335/124, 196, 187, 189, 335/203, 192, 126; 317/154

[56] References Cited

U.S. PATENT DOCUMENTS

| | | | |
|---|---|---|---|
| 1,944,940 | 1/1934 | Lear et al. | 335/203 |
| 3,273,093 | 9/1966 | Hayden | 335/203 |
| 3,436,701 | 4/1969 | Hayden | 335/203 |
| 3,742,405 | 6/1973 | Hayden | 335/203 X |
| 3,751,719 | 8/1973 | Guarasci et al. | 317/154 X |

*Primary Examiner*—J D Miller
*Assistant Examiner*—Fred E. Bell
*Attorney, Agent, or Firm*—James R. O'Connor; J. Richard Cavanagh

[57] ABSTRACT

The specification describes a device termed a silent obturator which is in the form of a flexible strip having at least one mounting hole at one end portion at least and supported in bowed or arcuate configuration between two supports, one of which is movable toward the other and which carries a "moveable" contact member near but not at the mid-point thereof whereby motion of one support relative to the other causes outward or inward deflection of the obturator relative to a line between the supports in such manner as to displace the contact member toward the fixed support in one coordinate direction and away from the line between said supports in another coordinate direction effectively providing a resultant path of motion at an angle to the line between said supports which, when said moveable contact member is placed in spaced association with a "fixed" contact member relatively fixed in space provides a contact action therewith which is substantially tangential relative to the bow or curve of the obturator thus effectively eliminating contact noise thereby to achieve a relay action which is silent.

6 Claims, 3 Drawing Figures

OBTURATOR STRUCTURE FOR SILENT AUTOMOTIVE RELAY

BACKGROUND OF THE INVENTION

The invention relates to a silent relay obturator in the form of a flexible strip adapted to be arcuately connected between a support at each end, one of said supports being movable toward or away from the other, said strip carrying a contact member near the midpoint of its length and adapted to move substantially tangentially for engagement with another contact.

FIELD OF THE INVENTION

The word "obturator" used in the manner of defining a movable armature member for a relay structure has been known heretofore in prior U.S. Pat. Nos. 3,391,360, 3,418,609 and 3,573,689 in which the inventor of the instant application assigned said inventions to the assignee of the present invention. As a consequence of such prior state of the art the term "obturator" as applied to a relay armature defines a class or kind of armature which defines a curve between its ends, one of the ends being anchored to a fixed junction or anchorage the other end in the state of the art above-mentioned being free and ordinarily carrying a contact member ordinarily identified as "moveable" as contrasted with a "stationary" contact which it engages. In the prior art the fixed relay contact is spring biased and is moveable in one direction against such spring when engaged by the moveable contact. A singular disadvantage arises from a construction of a relay armature whether it be of relatively straight cantilever type or of an armature obturator "C"-shaped or curved type in that the moveable contact member in its motion between closed and open relay conditions defines a substantially straight line of action substantially at right angles to the face of the stationary contact member which it is designed to engage. Such condition of direct coaxial line of action engagement between contacts of a relay results in a relatively short life of the contact elements especially during a break or opening of said contacts under relatively high current conditions. Such breaking results in a localized heating of surfaces thereby rendering same subject to active oxidation, such oxidation contributing to an insulation of fresh metal surface for successive contact in the following engagement of said contact members. Under heavy current conditions the smaller area of contact thus afforded leads to a higher concentration of current over smaller areas and temperatures leading in turn to pitting and erosion conditions as a result of which the contact members or elements deteriorate rapidly.

In the context of the residence of the present invention the problem to be solved in the reliable action of the relay contacts over a prolonged life is one requiring the repeated action of said contact elements under making and breaking conditions in excess of two million cycles under full current conditions. For example, in the design of a relay adapted to communicate a particular current flow, such current flow desired will determine the contact area of a contact member and in addition having regard to duty cycle will determine the thickness and volume of such contact member having regard to heat energy dissipation relative to the duty cycle. Further by way of example, the designer given a value of direct current to be communicated between relay contacts for a predetermined period of time the contacts to open thereafter for another predetermined period of time, thereafter the contacts to close again will call for a larger volume of contact metal than that for a service duty cycle having a shorter period of engagement of said contacts without change of the open period. Present designers allow for a contact body volume vastly greater than the theoretical requirement and many times the surface area of contact in order to compensate for oxidation and pitting and resulting in high heat loss due to the conditions above described.

The obturator fashioned according to the invention enables the substantial avoidance of oxidation and pitting conditions of the prior art enabling a design closer to theoretical as to contact surface areas and volume and a vastly increased endurance as contrasted with the state of the art.

SUMMARY OF THE INVENTION

The invention concerns a relay obturator mountable between a fixed support and an anchorage movable toward and away from said support and defined by a flexible strip having a mounting portion at each end thereof and having therebeween a body portion of uniform thickness substantially less than the width thereof. One of said mounting portions embodies a juncture area adapted to be fastened to the fixed support, said area being characterized by a centroid thereof. The other of the mounting portions of the obturator embodies an anchorage area adapted to be fastened to the moveable anchorage, the anchorage area likewise being characterized by a centroid thereof. A moveable contact member is carried by the strip and is located thereon near the mid-point of the length of said strip between said centroids, said mid-point being hereinafter sometimes referred to as an apex of the obturator, the contact member not being located at the apex but being located at an angle relative to the line between the moveable anchorage and said fixed support. The location of the contact member on the obturator relative to the connection of the obturator to the anchorage and fixed support provides motion of said contact member at an angle relative to the theoretical line between the anchorage and said support generally tangential to the arc and curvature of said obturator substantially at said contact member.

DETAILED DESCRIPTION OF THE INVENTION

Figure 1:
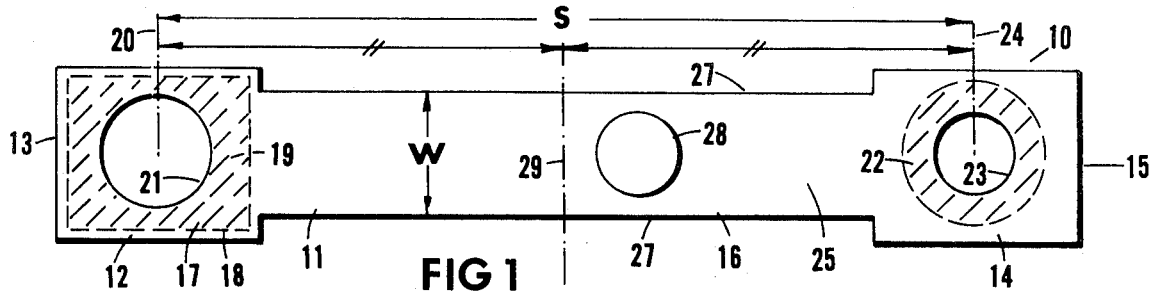
FIG. 1 is a plan view of a typical obturator member of the invention.
Figure 2:
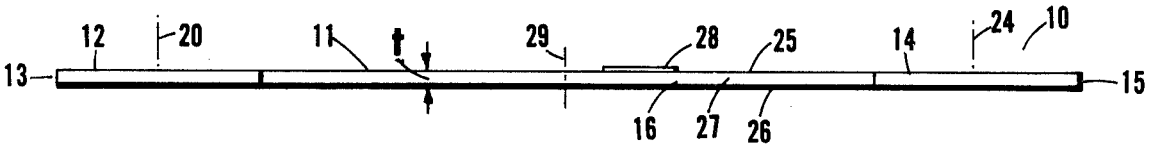
FIG. 2 is a side elevation of the obturator of FIG. 1.

In FIGS. 1 and 2 the obturator 10 of the invention comprises a flexible strip 11 having a stationary anchorage portion 12 at one end 13 and a moveable anchorage portion 14 at the other end 15, the obturator having a body portion 16 extending between said end portions and of a uniform thickness "*t*" substantially less than the width "*w*." Stationary anchorage portion 12 embodies a fixed anchorage area 17 bounded by chain lines 18 having area hatching 19. The centroid or centre 20 of such area may be the centre also of a mounting hole 21.

The other end 15 of the obturator in its moveable anchorage portion 14 embodies a moveable anchorage area 22 which may embody a central hole 23 having a centre or centroid 24 defining the centre of area 22.

The obturator 10 being generally in the nature of a strip of springy material (preferably spring bronze) exhibits two flat faces or as shown in FIG. 2 two parallel spaced apart faces 25, 26 terminating in side edges 27 and ends 13 and 15. One of the faces at least, such as face 25 carries a ("moveable") contact member 28 fastened thereto by suitable means such as rivetting, soldering, welding or electroplating to locate same near but not at the mid-point 29 of the length "s" of said obturator as measured between the centroids 20 and 24. As will be evident hereinafter the contact member 28 may be very thin, that is to say of the order of one thousandth of an inch in thickness but preferably thicker and, while here shown rivetted to the obturator, may be electroplated onto surface 25. The material of said contact member in the active contacting surface 38 thereof at least may be any one of the well-known contact member materials utilized in the art but in the case of the present invention is preferably silver.

Figure 3:
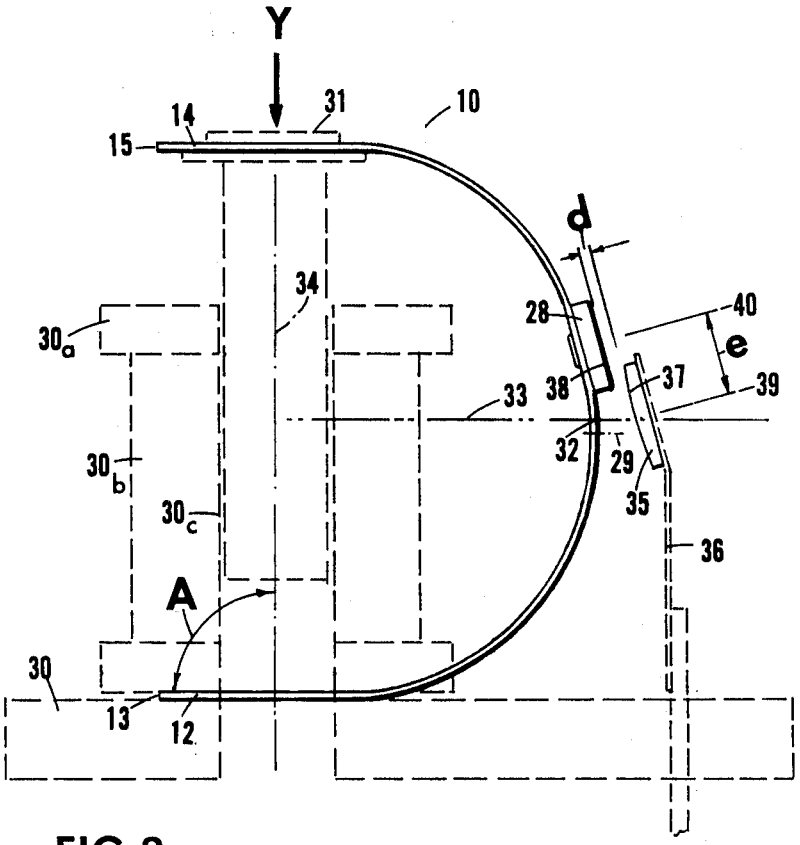
FIG. 3 is a side elevation of the obturator of the invention in association with a moveable anchorage in fixed support, the latter being shown diagrammatically and characterized by two directions of motion and shown in association with an articulating contact characterized by one degree of motion.

As seen in FIG. 3 stationary anchorage portion 12 is fixable to a base 30 by coil form 30*a* carrying relay winding 30*b* and having a plunger bore 30*c* the axis of which is located at an angle A relative to the path of motion or line of action Y of a moveable anchorage comprising an iron rod plunger 31 fastened to the moveable anchorage portion 14 of the obturator 10 to provide an initial or first curvature as shown in bold lines characterized by an apex point 32 which because the curve is compound in this case is not at midpoint 29 but is intersected by bisector line 33 at right angles to axis 34 between the moveable anchorage 31 and stationary anchorage portion 12. If the angle A is greater than 90° the location of the apex will be shifted upwardly of FIG. 3 so that in such circumstances the apex may not be precisely at the midpoint of the length of the obturator between the stationary and movable supports or anchorages. The "stationary" contact member 35 is supported by spring 36 to present its working face 37 parallel to the working face 38 of moveable contact member 28, the latter forming a part of and being connected to the obturator 10 of the invention, the working faces 37 and 38 of the contact members being initially spaced apart by a predetermined minimum distance "*d*." Fixed contact member is preferably intersected at its centre 39 by bisector line 33. The centre 40 of working face 38 of moveable contact member 28 is eccentrically spaced from centre 39 of the fixed contact member 35 by a distance "*e*" which is preferably at least equal to the maximum sliding action to be achieved during engagement of the contacts. The presentation of essentially fresh surfaces provided by sliding contact action with small change in angle between contact surfaces results in vastly extended contact life. The contact angle should be a minimum of $d/e$ = min. The volume of metal in contact member 28 can be greatly reduced because of movement of surfaces during contact resulting in contact member design considerations much different from those dictated by prior limitations as to heat generation and distribution under direct essentially coaxial contact concepts of the prior art.

Where at least one of the surfaces 37 and 38 of the contact members is provided in slightly arcuate form especially of a radius corresponding to that of the curvature of the obturator, it will be evident that an effectively negligible angle between contact surfaces during sliding engagement of the contacts can be achieved. It will be realized that the surface 38 of the moveable contact member 28 curves with the obturator when such moveable contact member is an electroplated layer of silver or other suitable contact metal plated on the obturator at least near the apex thereof remote from the fixed anchorage portion 12. Further, it will be evident that in such event the stationary contact member 35 in its contact face 37 may be flat. Regardless, in referring to the planes of the faces of the contact members it will be understood that in the context of this specification the meaning intended is "the effective plane" of said faces necessarily referred to herein in order to bring out the importance of an angle of contact between contact faces during sliding engagement which is effectively negligible.

The term "near" as used in this specification is of ordinary meaning to the extent that if the moveable contact is near the apex remote from the stationary anchorage portion of the obturator it cannot be near to either the moveable anchorage portion or the stationary anchorage portion and must therefore be located near the apex but between the apex and a point on the obturator lying midway between the apex and the moveable anchorage portion.

What is claimed is:

1. A silent obturator for a direct current relay having a stationary anchorage and spaced therefrom a movable anchorage, the latter being movable in the line of direction generally toward the stationary anchorage, said obturator comprising: a flexible strip of material having stationary and movable mounting end portions defining respectively between the ends thereof a predetermined unsupported length between said mounting portions, said unsupported length being substantially greater in length than the maximum distance between the stationary anchorage and the movable anchorage of the relay and defining a curve along said unsupported length of the strip between said anchorages upon fixture of the stationary mounting portion to the stationary anchorage and fixture of the movable mounting portion to the movable anchorage; and a contact member including contact surfaces thereof comprising electrically conducting material located on said strip at least near the midpoint of the unsupported length of said strip and remote from said stationary anchorage portion, said contact surfaces being movable in a direction substantially tangent to the curve of the strip at said contact surfaces.

2. The obturator of claim 1 in which the contact member comprises a disc of electrically conducting material of an effective diameter less than the width of said flexible strip.

3. The obturator of claim 1 in which the contact member comprises an electroplated material.

4. The obturator of claim 1 having at least one mounting hole in at least one of the mounting portions thereof.

5. In a direct current relay having a stationary anchorage, a movable anchorage spaced from the stationary anchorage, and a relay winding located between said anchorages and fixed to said stationary anchorage, an improved obturator comprising a flexible strip of material having stationary and movable mounting end portions defining respectively between the ends thereof a predetermined unsupported length between said mounting portions, said unsupported length being substantially greater in length than the maximum distance between the stationary anchorage and the movable anchorage of the relay and defining a curve along said unsupported length of the strip between said anchorages upon fixture of the stationary mounting portion to the stationary anchorage and fixture of the movable mounting portion to the movable anchorage, and a contact member having contact surfaces located on said strip at least near the midpoint of the unsupported length of said strip and remote from said stationary anchorage portion, the contact surfaces near said midpoint being movable in a direction substantially tangent to the curve of the strip at said contact surfaces.

6. The relay of claim 5 in which the movable anchorage comprises a plunger of ferrous material having one end thereof fastened to the movable mounting portion of said obturator and the other end thereof slidably located within said winding

* * * * *